US007594802B2

(12) United States Patent
Gray, Jr.

(10) Patent No.: US 7,594,802 B2
(45) Date of Patent: Sep. 29, 2009

(54) LARGE ANGLE SLIDING VALVE PLATE PUMP/MOTOR

(75) Inventor: Charles L. Gray, Jr., Pinckney, MI (US)

(73) Assignee: The United States of America as represented by the Administrator of the U.S. Environmental Protection Agency, Washington, DC (US)

( * ) Notice: Subject to any disclaimer, the term of this patent is extended or adjusted under 35 U.S.C. 154(b) by 737 days.

(21) Appl. No.: 10/828,971

(22) Filed: Apr. 21, 2004

(65) Prior Publication Data

US 2005/0238517 A1 Oct. 27, 2005

(51) Int. Cl.
*F04B 1/12* (2006.01)
*F01B 3/00* (2006.01)
*F01B 13/04* (2006.01)

(52) U.S. Cl. ..... 417/269; 91/501; 92/12.2

(58) Field of Classification Search ..... 417/269; 91/506; 92/12.2

See application file for complete search history.

(56) References Cited

U.S. PATENT DOCUMENTS

| | | | | |
|---|---|---|---|---|
| 3,233,555 | A * | 2/1966 | Wahlmark | 91/506 |
| 3,382,813 | A * | 5/1968 | Schauer | 91/506 |
| 4,129,063 | A | 12/1978 | Ifield | 91/506 |
| 4,872,394 | A | 10/1989 | Nakagawa et al. | 91/506 |
| 4,893,549 | A * | 1/1990 | Forster | 92/12.2 |
| 4,991,492 | A * | 2/1991 | Bratt et al. | 92/12.2 |
| 5,094,114 | A | 3/1992 | Date et al. | 74/89.15 |
| 5,094,144 | A | 3/1992 | Akasaka et al. | 91/486 |
| 6,604,446 | B1 * | 8/2003 | Skirde et al. | 92/12.2 |
| 2004/0173089 | A1 | 9/2004 | Gray, Jr. et al. | 91/505 |

FOREIGN PATENT DOCUMENTS

| | | |
|---|---|---|
| DE | 1 296 006 | 5/1969 |
| EP | 1 008 748 B1 | 2/2005 |
| GB | 1 552 350 | 9/1979 |

OTHER PUBLICATIONS

Axial Piston Variable Displacement Motor AA6VM, from Rexroth (Bosch Group), known as of at least Oct. 3, 2003, photos attached.

Hydraulic Motor Series V12 Variable Displacement, from VOAC (Parker Hydraulics), known as of at least Oct. 3, 2003, photos attached.

* cited by examiner

*Primary Examiner*—Devon C Kramer
*Assistant Examiner*—Peter J Berthheaud
(74) *Attorney, Agent, or Firm*—Seed IP Law Group, PLLC

(57) ABSTRACT

A pump/motor includes a back plate having first and second fluid ports configured to be differentially pressurized, first and second reaction plates rigidly coupled to the back plate, and a valve plate slideably coupled to the back plate and having first and second fluid feed channels configured to receive fluid from the first and second fluid ports. A plurality of hold-down pistons is positioned in respective hold-down cylinders formed in the valve plate. Each of the hold-down pistons is configured to be biased, by pressurized fluid in the respective hold-down cylinder, against a surface of one of the reaction plates. A barrel, having a plurality of drive cylinders, is rotatably coupled to the valve plate. Drive pistons positioned in the drive cylinders are biased against a thrust plate by pressurized fluid in the drive cylinders. The thrust plate is coupled to an output shaft of the pump/motor.

21 Claims, 11 Drawing Sheets

LARGE ANGLE SLIDING VALVE PLATE PUMP/MOTOR

BACKGROUND OF THE INVENTION

1. Field of the Invention

The present application relates in general to hydraulic machines, and in particular to a yokeless pump/motor with a sliding valve plate.

2. Description of the Related Art

Pump/motors having sliding valve plates are well known in the industry. An advantage that such motors have over pump/motors employing a yoke and trunnion for displacement control is fewer moving parts. However, for reasons that will be explained below, sliding valve plate pump/motors are generally limited as to the maximum stroke angle possible. Inasmuch as maximum available efficiency and energy transfer are directly related to maximum stroke angle, a long-sought goal has been the development of sliding valve plate pump/motors capable of displacement angles greater than around 20 degrees.

Referring to FIG. 1, the back plate 100 of a known pump/motor is shown. The sliding surface 102 may be seen, whereon a valve plate is configured to ride. The lateral position of the valve plate 108, as shown in FIG. 2, is controlled by the rocking pin 106. Fluid feed apertures 104 provide high and low pressure fluid to the valve plate 108.

The back side 108*b* of the valve plate 108 may be seen in FIG. 2. The valve plate 108 includes fluid feed channels 112 configured to receive fluid from the fluid feed apertures 104 of the back plate 100, and to transmit that fluid to the piston barrel of the pump, via the kidney slots, or valve slots 116, visible through the fluid feed channels 112, and more easily visible in FIG. 3. Sealing lands 110 provide a seal between the sliding surface 102 of the back plate and the valve plate 108.

FIG. 3 shows the top surface 108*a* of valve plate 108. The top surface 108*a* includes the valve slots 116, the annular sealing land 118, and the barrel pin 103. A cylinder barrel is configured to sit on the top surface 108*a* of the valve plate 108 and engage the barrel pin 103. When operating in motor mode, cylinder ports in a bottom surface of the barrel receive high-pressure fluid from one of the valve slots 116 and, as the barrel rotates, discharge the fluid into the opposite side valve slot 116, in a known manner.

The displacement of the pump/motor, and hence the degree of energy transfer, is determined by the angle of an axis of the barrel relative to an axis of a thrust plate and output shaft of the pump/motor. This is sometimes referred to as the stroke angle of the machine. The rocking pin 106, shown in FIG. 1, is configured to engage the rocking bore 114 of FIG. 2 for the purpose of adjusting the angle of the barrel.

By comparing the bottom surface 108*b* of the valve plate 108 with the back plate 100, it may be seen that the travel of the valve plate 108 over the back plate 100 is limited by the length of the fluid feed channels 112, and the length of the sliding surface 102. It will be understood that in order for the pump/motor to function properly, the sliding surface 102 must be sufficiently broad such that when the valve plate is at either extreme end of its travel, the entire length of each of the sealing lands 110 is in contact with the sliding surface 102. Additionally, when the valve plate 108 is at either extreme, the fluid feed apertures 104 must have access to the fluid feed channels 112. Thus, it would seem a simple matter, in order to produce a pump/motor capable of greater displacement angles, to manufacture a valve plate having longer fluid feed channels 112, and correspondingly broader sliding surfaces 102. However, significant design problems arise when such modifications are attempted.

Reference is made to FIGS. 4 and 5 to facilitate an explanation of the problems associated with changing the dimensions of the fluid feed channel 112.

Where the value n is used in the figures and descriptive text to indicate an undefined quantity, it will be understood that any number of the indicated feature may be appropriate. For example, in the case of drive cylinders and pistons, as described below, an odd number, such as seven or nine, is generally employed, though machines utilizing other quantities are also known.

FIGS. 4 and 5 show diagrammatical cross-sections of a sliding valve plate pump/motor 133 of a type similar to that illustrated in FIGS. 1-3. More particularly, FIG. 4 shows a cross-section taken in a plane X, indicated in FIG. 5 at lines 4-4, while FIG. 5 is taken in a plane Y. FIGS. 4 and 5 are diagrammatical in nature, and do not represent a functional machine. In particular, the cylindrical barrel 107 and semicircular kidney port 117 of FIG. 5 are depicted as being flat or planar for the purpose of describing forces acting on the various components of the pump/motor.

The pump/motor 133 of FIGS. 4 and 5 includes a back plate 101, a valve plate 109, and a barrel 107. Pistons 111*a*-111*n* are positioned within respective cylinders 115*a*-115*n*. Pressurized fluid is provided to the pump/motor 133 via fluid feed passage 121 and fluid feed aperture 105. The pressurized fluid passes into the valve plate 109 via the fluid feed channel 113, and from the valve plate 109 to the barrel 107 via the valve slot 117. The fluid enters each of the cylinders 115 via cylinder ports 123*a*-123*n*.

Pascal's law teaches that a pressurized fluid in an enclosed space exerts equal pressure on all surfaces of that space. Accordingly, with reference to FIG. 4, fluid entering cylinder 115*b* via cylinder port 123*b* will exert equal pressure on all surfaces within the cylinder 115*b*. Assuming that the pump/motor 133 is functioning as a motor, and that the fluid entering the fluid feed passage 121 is at a drive pressure, the pressure of the fluid will drive the piston 111*b* in an upward direction. Since force acting on the piston 111*b* in an upward direction is not transmitted to the barrel 107, there is substantially no upward force exerted on the barrel 107, by fluid inside the cylinder 115*b*. However, the pressurized fluid is also acting on the cylinder's shoulders 119 in a downward direction, pushing the barrel downward onto the valve plate 109, and the valve plate 109 downward onto the back plate 101. Inasmuch as FIG. 4 shows no surfaces of the valve plate 109 on which the fluid is acting, there is a net downward force from the barrel 107, through the valve plate 109, to the back plate 101, with respect to the surfaces shown in FIG. 4. This is sometimes referred to as the clamping force, and, in most known sliding valve plate systems, is the major force holding the barrel 107 and valve plate 109 against the back plate 101.

Referring now to FIG. 5, it may be seen that, in the Y plane, there are several surfaces upon which pressurized fluid may act to generate upward force. For example, the barrel 107 has a surface 125 that is in contact with pressurized fluid, which affects the net clamping force of the cylinder barrel 107. Additionally, valve plate 109 has interior surfaces 131 upon which pressurized fluid will exert upward pressure. Finally, there is a pressure gradient across the sealing lands 110 (see FIG. 2) that imposes a net upward force on the valve plate 109.

It will be understood that, in order for the pump/motor 133 to function properly, the total downward force acting on the valve plate 109 must exceed the total upward force, to prevent the valve plate 109 from lifting from its position. The sum of these forces can be referred to as the net lifting force. The net lifting force F acting on the valve plate 109 of the pump/motor 133 may be approximated as follows:

$$F = (C + G)\text{in}^2 \times \frac{\text{lb.}}{\text{in}^2} - B \qquad \text{Formula 1}$$

Where C is equal to the total area of the fluid feed channel 113 minus the total area of the valve slot 117, G is equal to half the total area of the sealing lands 110, B represents the net clamping force of the cylinder barrel 107, and the pounds per square inch represents the fluid pressure in psi.

As long as the resulting value of F is a negative value, the pump/motor 133 will function properly. However, if the resulting figure is a positive value, the barrel 107 and the valve plate 109 will not remain properly seated, and pressurized fluid will escape from the system, preventing the pump/motor 133 from functioning. In simple terms, the net clamping force of the barrel 107 must be greater than the sum of forces acting on the sealing lands 110 and the horizontal component of the surfaces 131 of the valve plate.

Returning now to the question of lengthening the fluid feed channel in order to improve the maximum displacement capability of the pump/motor 133, it may be seen that, as the dimension $C_Y$, representing the length of the fluid feed channel 113, increases, so too will the surface area 131 of the valve plate 109. As the surface area 131 increases, the upward forces acting on that surface area will very quickly overcome the downward forces acting on surface areas 119 to cause the valve plate 109 to separate from the back plate 101. A common response to this problem has been to increase the surface area of the shoulders 119 of the cylinders **115*a*-115*n*. To do this, the cylinder ports 123 are narrowed in the dimension indicated at $P_x$ of FIG. 4, thus broadening the shoulders 119. However, when the dimension $P_x$ is reduced, the width of the valve slot 117, the fluid feed channel 113, and the fluid feed aperture 105, indicated in FIG. 4 as dimensions $S_x$, $C_x$, and $B_x$, respectively, must each be reduced in turn. This results in narrowing the fluid passages, especially the fluid passing through the fluid feed aperture 105, and entering the cylinder ports 123. As a result, the rate of fluid transfer into the cylinders 115*a*-115*n* is reduced, or choked, reducing the efficiency with which the motor transfers energy. Thus, in order to increase the maximum displacement angle of the pump/motor 133**, efficiency is sacrificed.

BRIEF SUMMARY OF THE INVENTION

According to an embodiment of the invention, a pump/motor is provided, including a back plate having first and second fluid ports configured to be differentially pressurized, a plurality of reaction plates rigidly coupled to the back plate, a valve plate slideably coupled to the back plate and having first and second fluid feed channels configured to receive fluid from the first and second fluid ports, and a plurality of hold-down pistons positioned in respective hold-down cylinders formed in the valve plate, each of the hold-down pistons configured to be biased, by pressurized fluid in the respective hold-down cylinder, against a surface of one of the reaction plates.

The pump/motor also includes a barrel, rotatably coupled to the valve plate and having a plurality of drive cylinders formed therein, a plurality of drive pistons, each having a first end positioned in a respective one of the plurality of drive cylinders, and a thrust plate having a surface configured to receive second ends of each of the plurality of drive pistons, the thrust plate coupled to an output shaft of the pump/motor.

According to another embodiment of the invention, a hydraulic machine is provided, including a back plate having a concave surface configured to slideably receive a valve plate thereon, first and second fluid ports formed in the concave surface and configured to transmit differentially pressurized fluid to the valve plate, and first and second reaction plates coupled to the back plate, each having a convex reaction surface substantially facing, and spaced a selected distance from, the concave surface of the back plate.

According to an embodiment of the invention, a method is provided, including the steps of coupling a first pressurized fluid source to a rotatable barrel via a first fluid feed channel in a valve plate and a first fluid port in a back plate, coupling a second pressurized fluid source to the rotatable barrel via a second fluid feed channel in the valve plate and a second fluid port in the back plate, biasing a first plurality of hold-down pistons against a first reaction plate coupled to the back plate, and biasing a second plurality of hold-down pistons against a second reaction plate coupled to the back plate.

BRIEF DESCRIPTION OF THE SEVERAL VIEWS OF THE DRAWING(S)

DETAILED DESCRIPTION OF THE INVENTION

According to the principles of the invention, means are provided for exerting a downward force on the valve plate, external to the fluid passages between the fluid feed and the cylinders of the barrel.

Features of an embodiment of the invention are illustrated with reference to FIGS. 6A-8.

Figure 1:
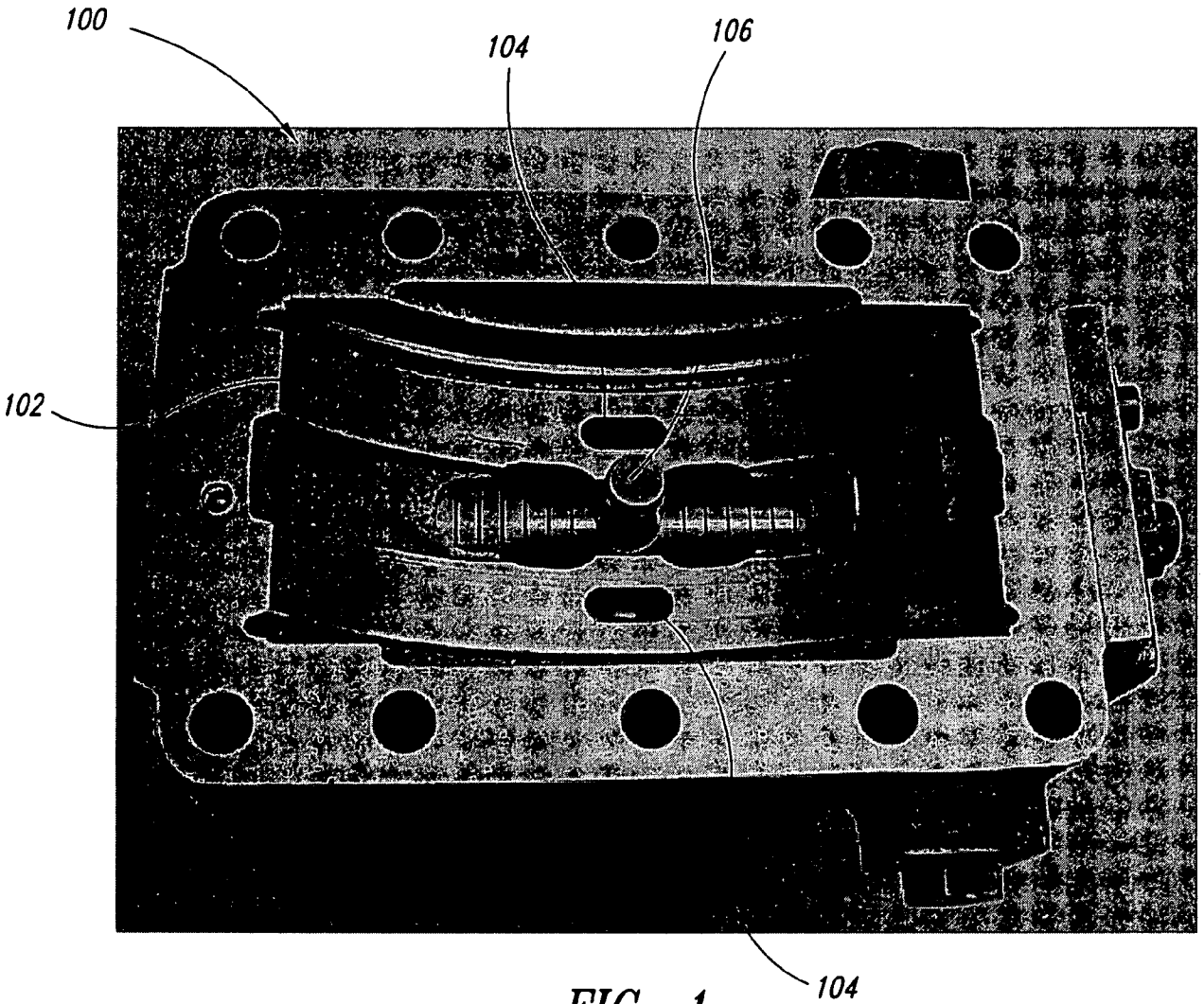
FIG. 1 (Prior Art)
FIG. 1 shows a back plate of a pump/motor, according to known art.
Figure 2:
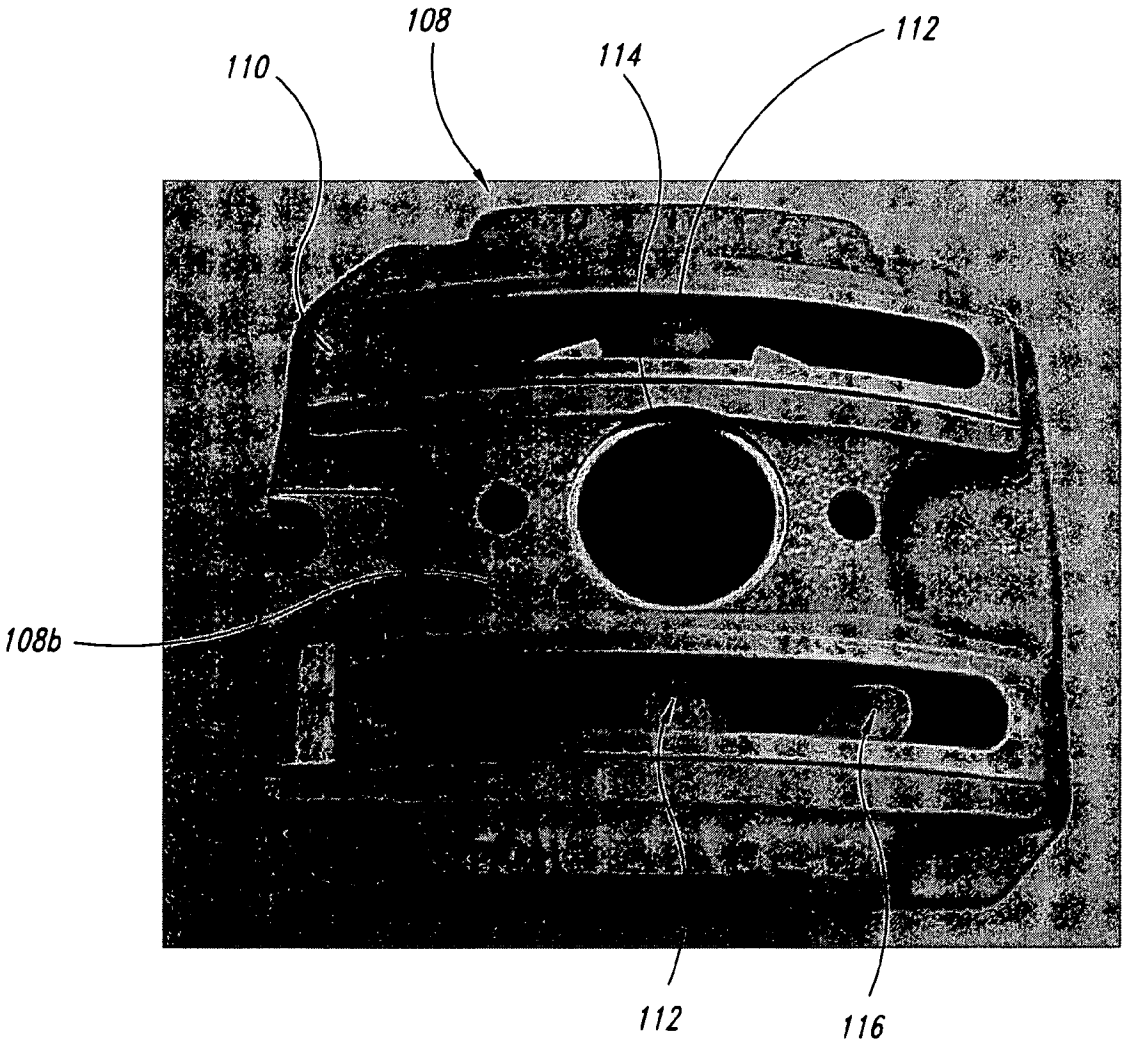
FIG. 2 (Prior Art)
FIG. 2 shows a back side of a valve plate of the pump/motor of FIG. 1.
Figure 3:
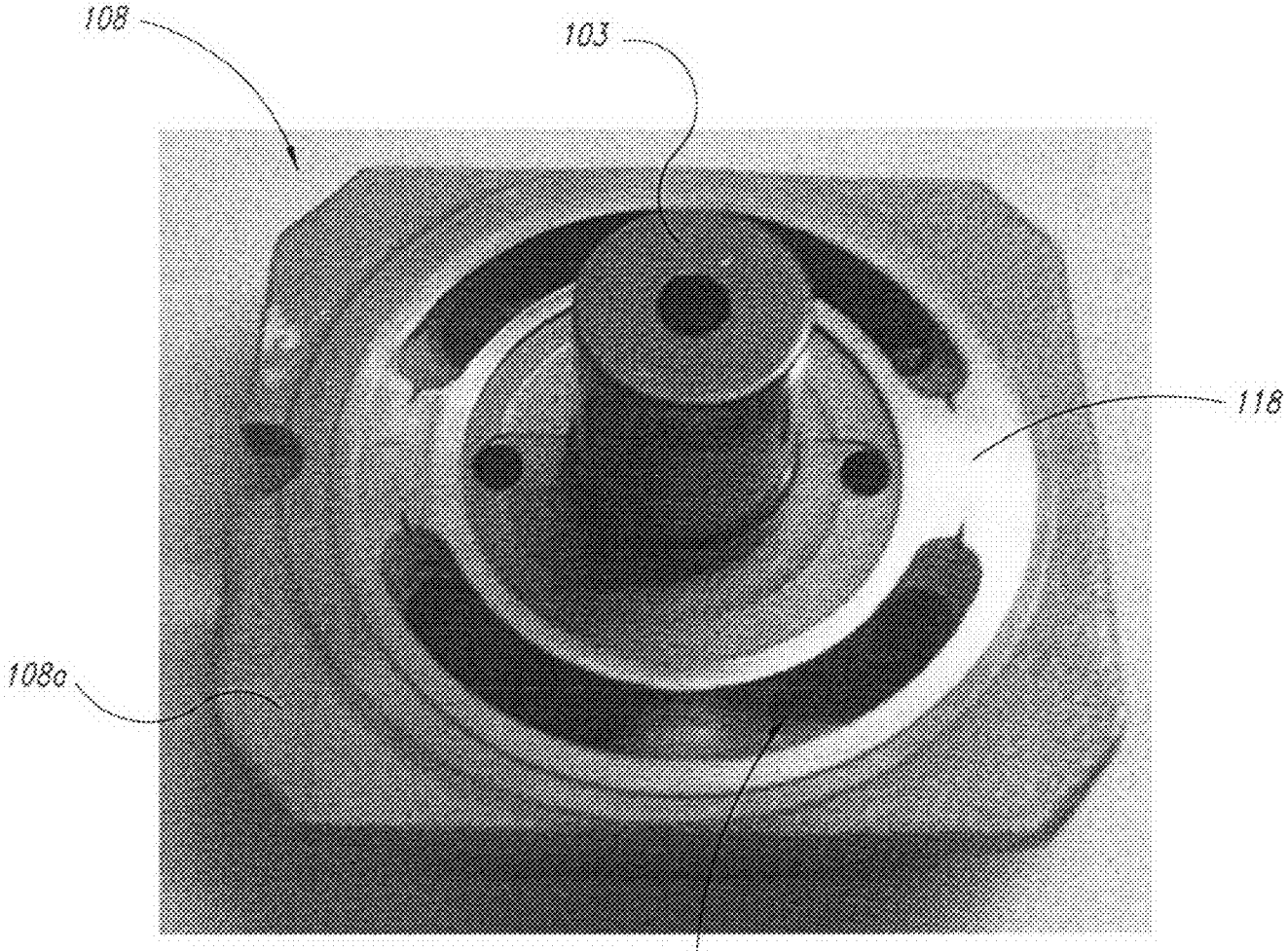
FIG. 3 (Prior Art)
FIG. 3 shows a front side of the valve plate of FIG. 2.
Figure 5:
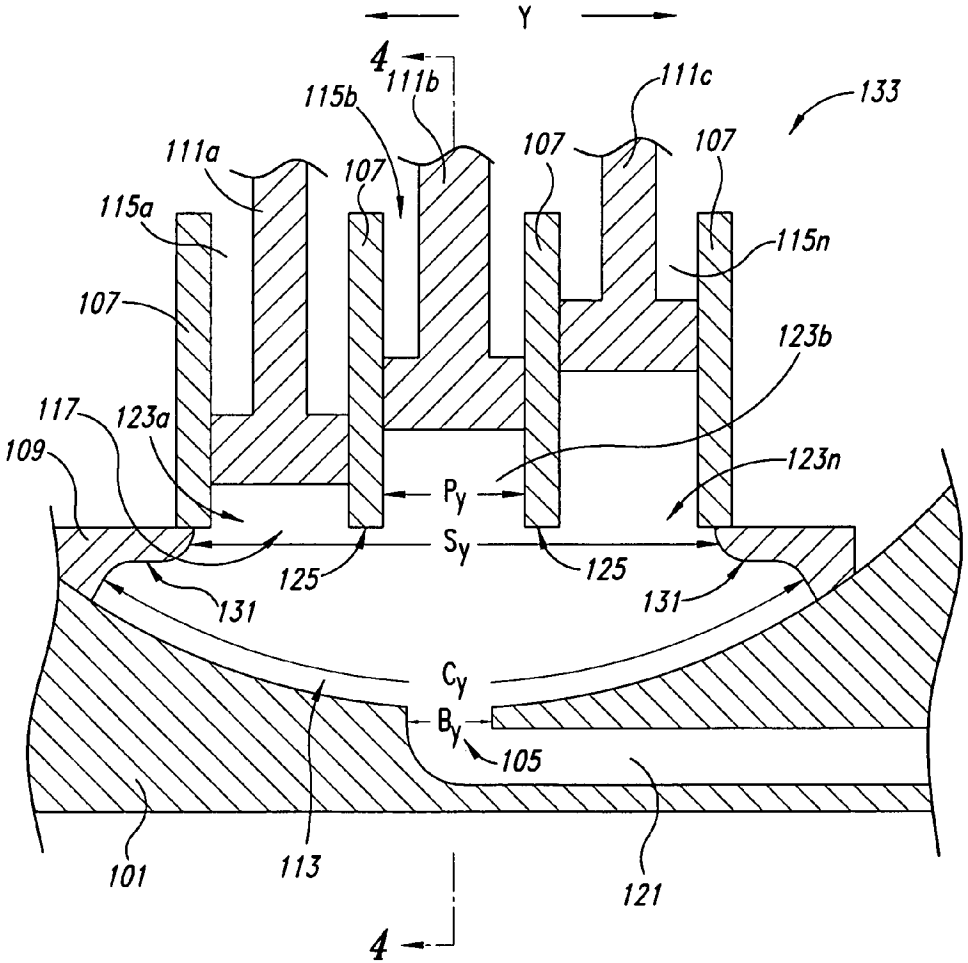
FIG. 5 (Prior Art)
FIG. 5 is a diagrammatic representation of the portion of a pump/motor of FIG. 4, in a second plane, perpendicular to the plane of FIG. 4.
Figure 4:
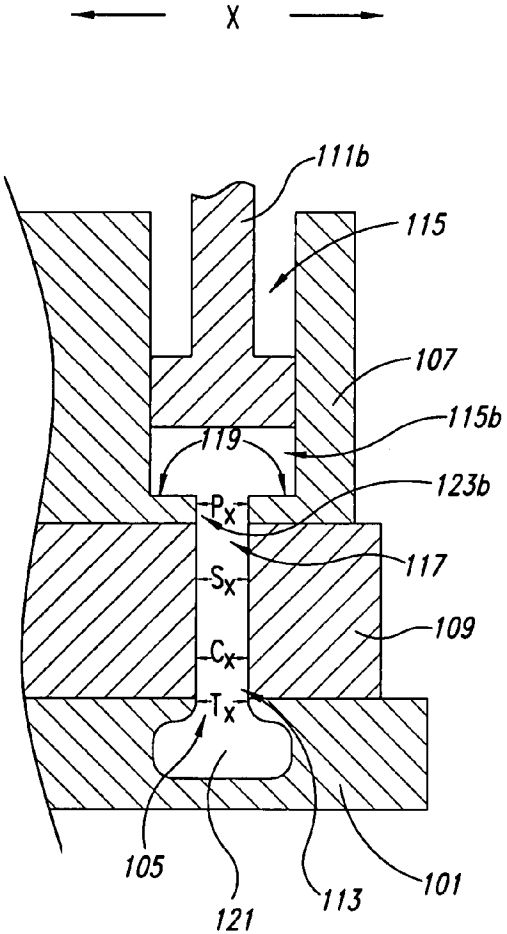
FIG. 4 (Prior Art)
FIG. 4 is a diagrammatic representation of a portion of a pump/motor according to known art, in a first plane.
Figure 6A:
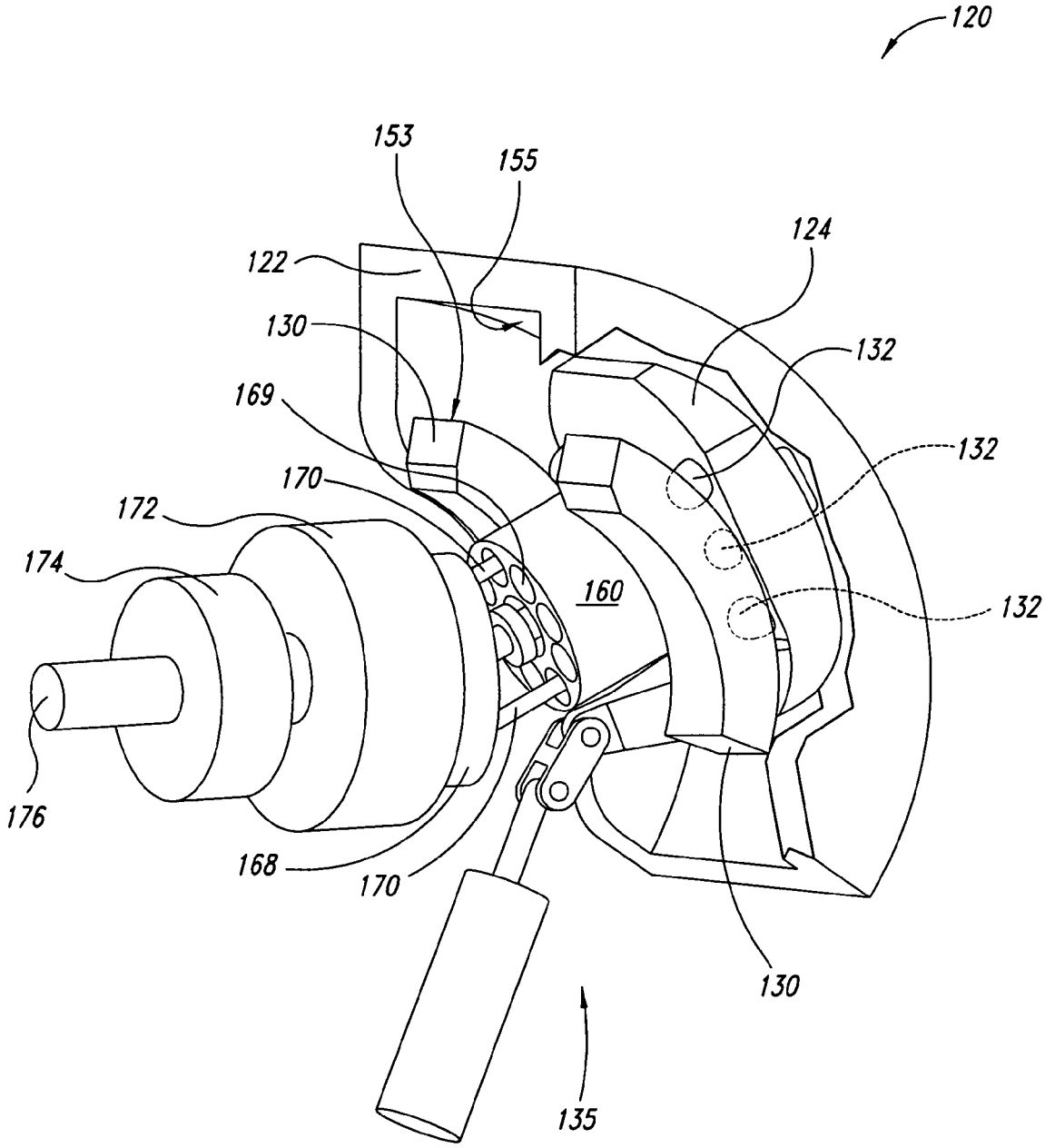
FIG. 6A is an orthographic view of a portion of a pump/motor according to an embodiment of the invention.

FIG. 6A shows a portion of a pump/motor 120, with a segment cutaway to reveal pertinent details. The pump/motor 120 includes a back plate 122, a valve plate 124, a barrel 160 having a plurality of drive cylinders 169 and drive pistons 170, of which only two are depicted, a thrust plate 168, a main bearing 172, and a drive bearing 174. A drive shaft 176 is coupled to the thrust plate 168.

The pump/motor 120 also includes reaction plates 130, rigidly coupled to the back plate 122. The valve plate 124 is provided with hold-down pistons 132, shown generally in hidden lines, along two sides thereof, and configured to bear upward against reaction plates 130. The reaction plates 130 include a convex reaction surface 153 substantially facing the concave surface 155 of the back plate 122, and spaced a distance therefrom, the distance being selected to accommodate the valve plate 124 and hold-down pistons 132.

An actuator and linkage 135 is provided to control the stroke angle of the valve plate 124 and barrel 160. As the actuator piston extends, the valve plate 124 is compelled to slide along the surface of the back plate 122, while the hold-down pistons 132 maintain a biasing force against the reaction plates, thereby holding the valve plate 124 firmly against the back plate.

Figure 6B:
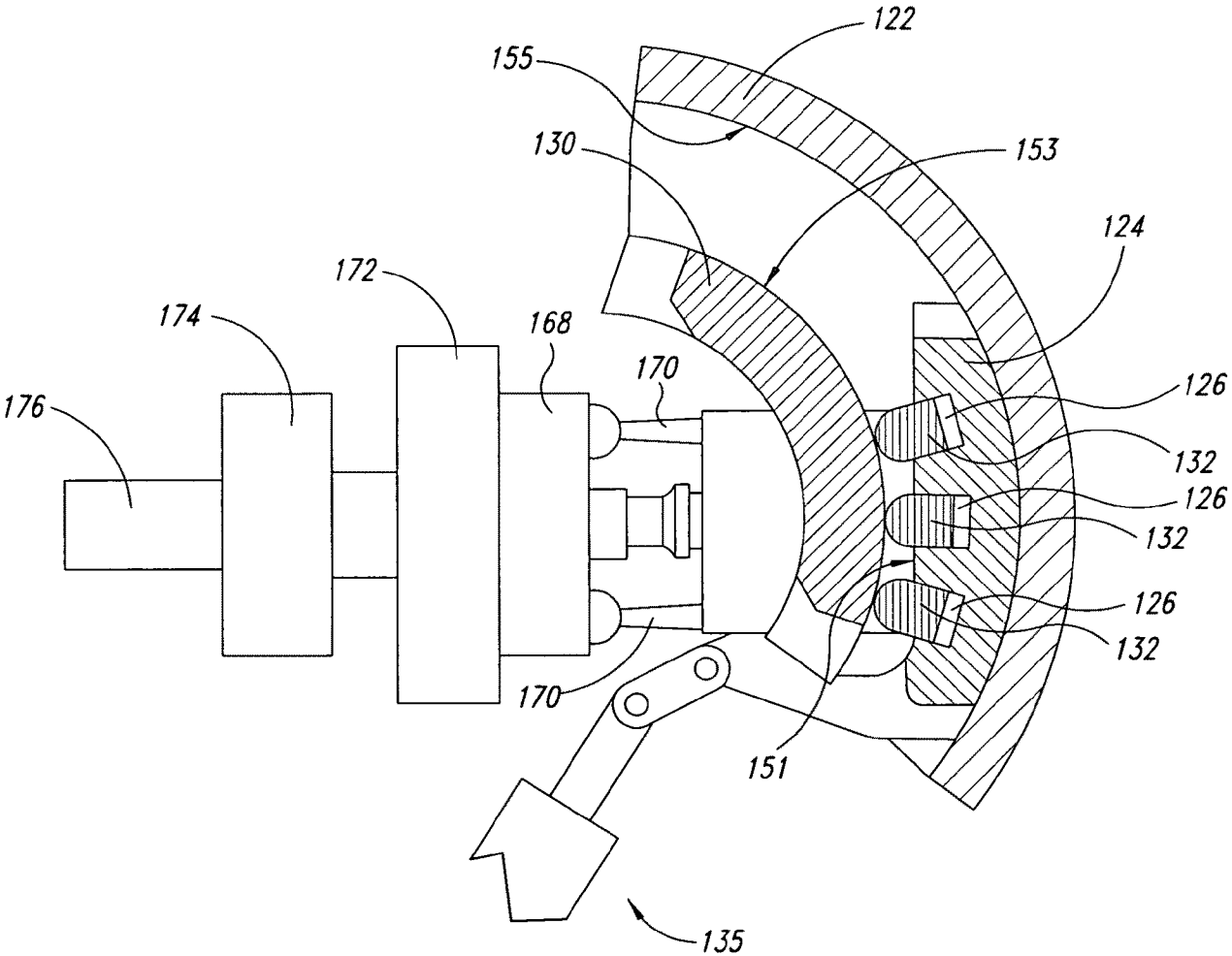
FIG. 6B is a sectional view of the portion of the pump/motor of FIG. 6A.
Figure 6C:
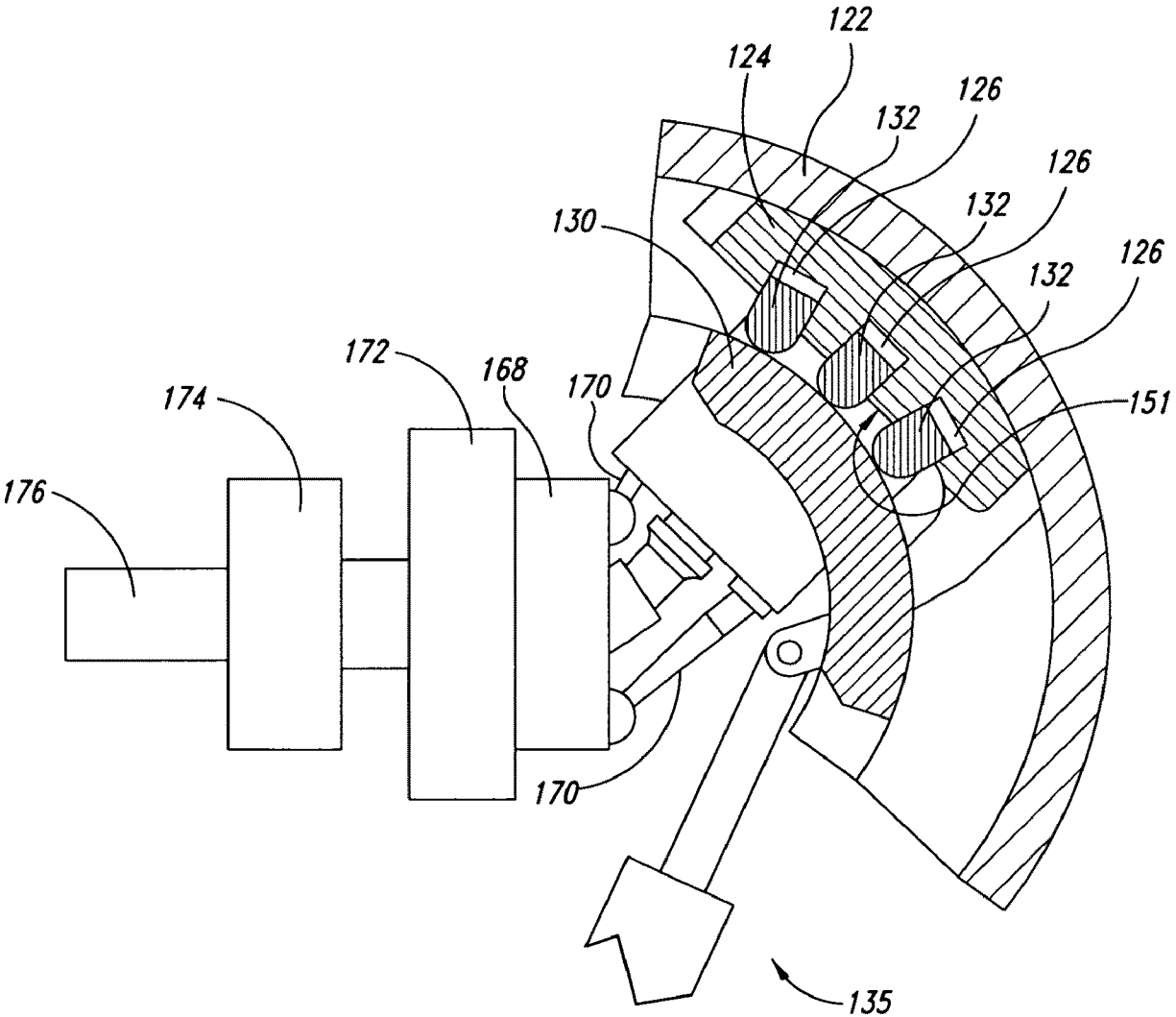
FIG. 6C is a sectional view of the portion of the pump/motor of FIG. 6A.

FIGS. 6B and 6C show the pump/motor 120 in a cross-section taken through the hold-down pistons 132 on one side of the valve plate 124. FIG. 6B shows the pump/motor 120 with a stroke angle of zero, while FIG. 6C shows the pump/motor with a maximum stroke angle. With reference to FIGS. 6A-6C, it can be seen that the reaction surfaces 153 of the reaction plates 130 and the convex surface 155 of the back plate 122 are in the form of sections of concentric cylinders.

It may be seen that the hold-down pistons 132 are each positioned in a respective hold-down cylinder 126. Each of the hold-down cylinders 126 is in fluid communication with a fluid feed channel 134, as will be described in more detail with reference to FIGS. 7A-8.

In operation, pressurized fluid is provided to selected hold-down cylinders 126 to act upon a bottom surface of each of the hold-down pistons 132, driving them outward against the reaction plates 130, and biasing the valve plate 124 firmly against the back plate 122. The hold-down pistons are configured to slide along the stationary reaction plate, maintaining biasing pressure thereon.

Figure 7B:
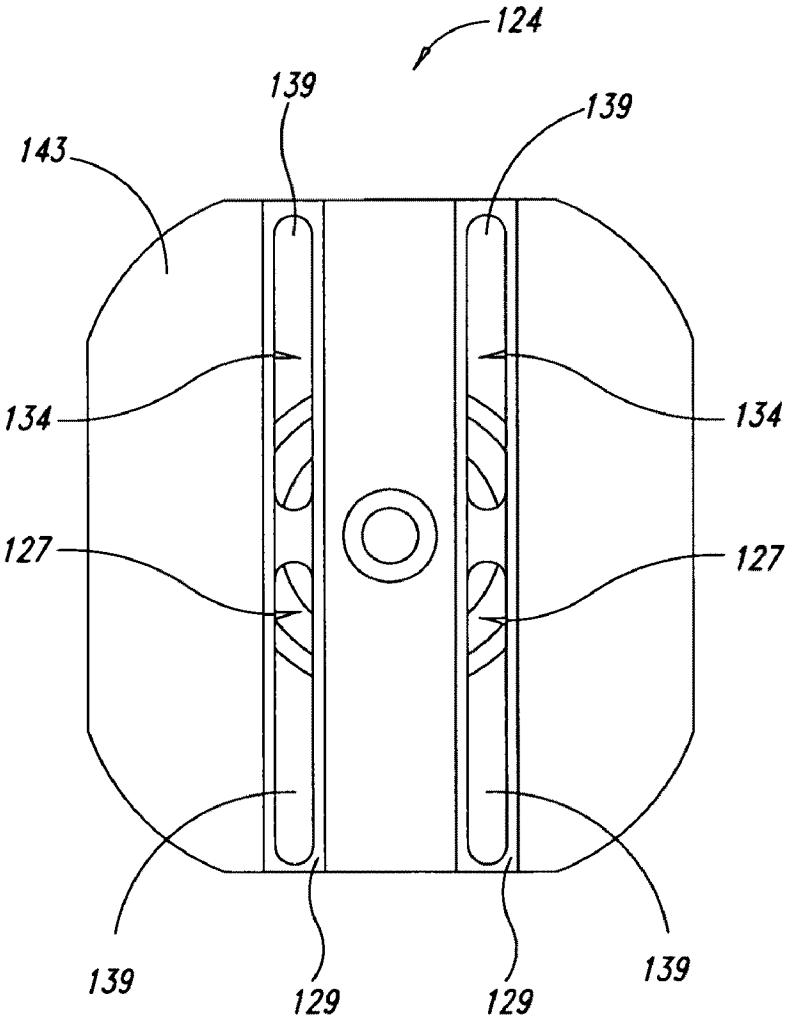
FIG. 7B is a bottom view of the valve plate of FIG. 7A.
Figure 7A:
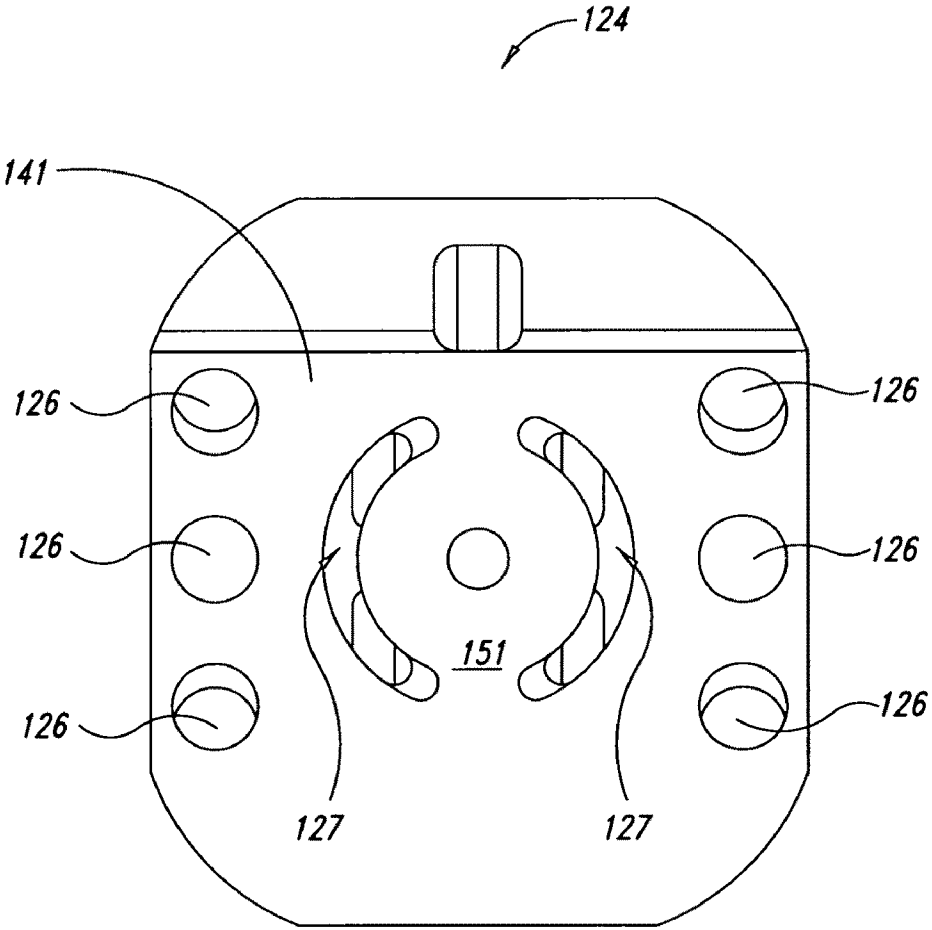
FIG. 7A is a top view of a valve plate of a pump/motor according to an embodiment of the invention.

FIGS. 7A and 7B show front and back views, respectively, of the valve plate 124.

The front surface 141 of the valve plate 124 includes valve plate apertures 127 and hold-down cylinders 126. The back surface 143 of the valve plate 124 includes sealing lands 129 and fluid feed channels 134. As most clearly shown in FIG. 7A, the central axis of each of the hold-down cylinders 126 lies in a plane that is substantially perpendicular to a surface 151 configured to receive a rotatable cylinder barrel. In the embodiment of FIG. 7A, the axes of three hold-down cylinders 126 on a left side of the valve plate 124 lie in a first plane, and the axes of three hold-down cylinders 126 on a right side of the valve plate 124 lie in a second plane, parallel to the first plane.

In a pump/motor according to known art, such a valve plate would separate from the back plate as soon as pressurized fluid was applied. However, the sum of the areas of the selected hold-down cylinders 126 is selected to compensate for the additional lifting force created by the added surface area 139. Accordingly, the length of the fluid feed channels is not limited by the dimensions of shoulders within the cylinders of the barrel 160, and thus, the maximum stroke angle is no longer limited by these constraints.

A new formula for approximating the net lifting force F acting to lift the valve plate and cylinder barrel may be expressed as follows:

$$F = (C + G - H)\text{in}^2 \times \frac{\text{lb.}}{\text{in}^2} - B \qquad \text{Formula 2}$$

Where H represents the total transverse sectional area of the selected hold-down cylinders 126.

Figure 8:
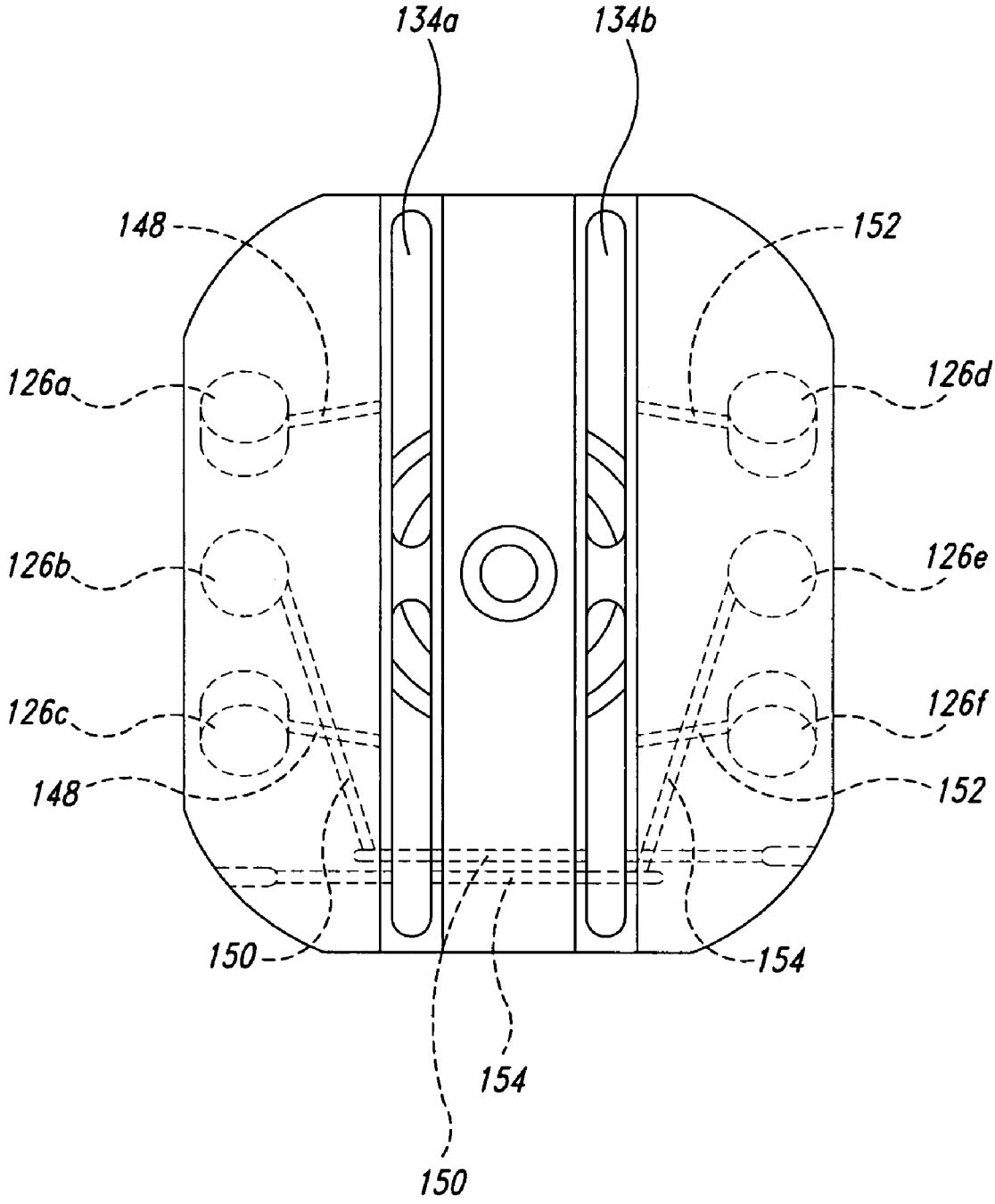
FIG. 8 shows a valve plate according to an embodiment of the invention, with internal fluid channels in phantom lines.

FIG. 8 shows porting channels for providing pressurized fluid to hold-down cylinders 126*a*-126*f*, according to an embodiment of the invention. Cylinders 126*a* and 126*c* are coupled to the fluid feed channel 134*a* by hold-down feed lines 148. Hold-down cylinder 126*b* is coupled to the fluid feed channel 134*b* by opposite side hold-down feed line 150. Hold-down cylinders 126*d* and 126*f* are coupled to the right side fluid feed channel 134*b* by hold-down feed lines 152, while cylinder 126*e* is coupled to the fluid feed channel 134*a* by opposite side hold-down feed line 154.

It will be understood that, during operation of the pump/motor 120, one of the fluid feed channels 134 will be coupled to a high-pressure fluid source, while the other will be coupled to a low-pressure fluid source. By providing the fluid coupling to the hold-down cylinders 126*a*-126*f* as previously described, high-pressure fluid is provided to two of the hold-down cylinders 126 adjacent to the fluid feed channel receiving high-pressure fluid, while one of the hold-down cylinders on the opposite side of the valve plate also receives high-pressure fluid. By the same token, low-pressure fluid is provided to two of the hold-down cylinders 126 adjacent to the fluid feed channel 134 receiving low-pressure fluid, while one of the hold-down cylinders 126 on the opposite side of the valve plate 124 also receives low-pressure fluid. In this way, balanced forces are maintained in the valve plate 124.

According to another embodiment of the invention (not shown), hold-down cylinders 126*a*-126*c* are coupled to the fluid feed channel 134*a*, while hold-down cylinders 126*d*-126*f* are coupled to the fluid feed channel 134*b*.

Figure 9:
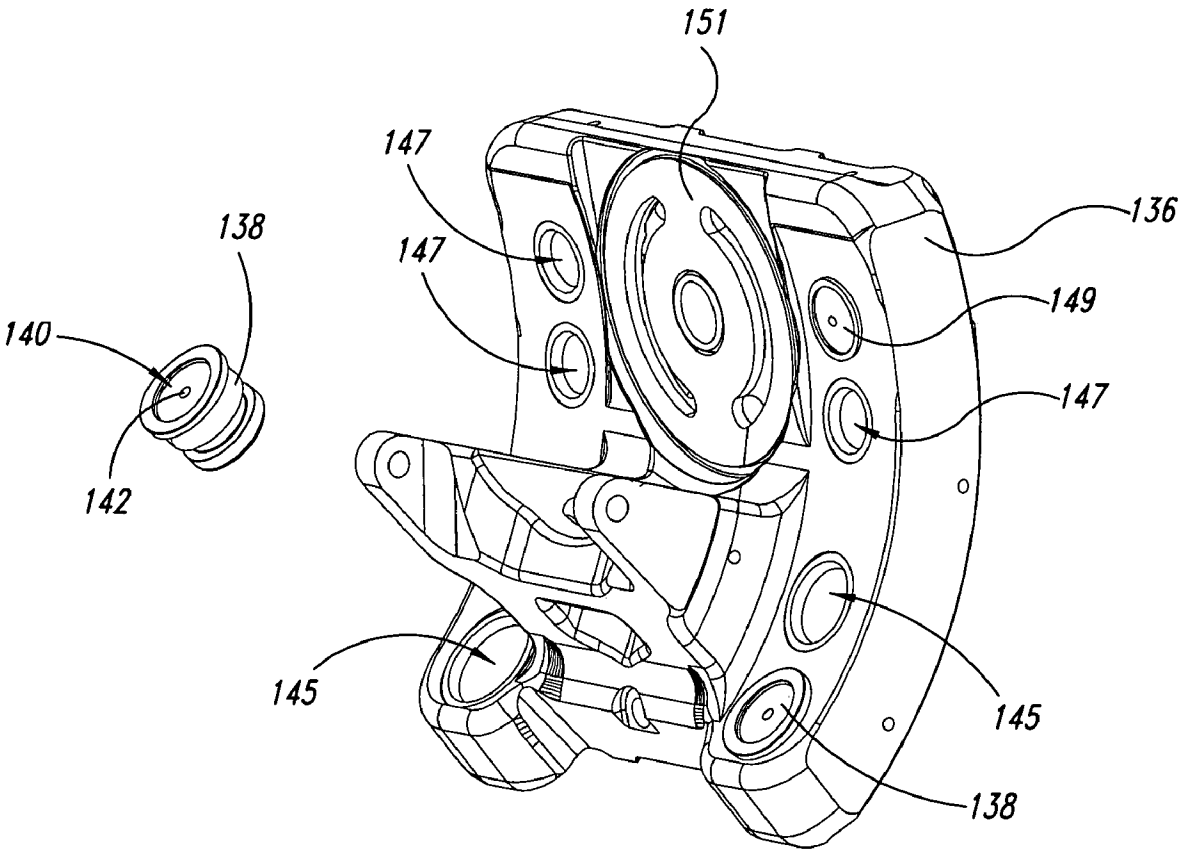
FIG. 9 is an orthographic view of a valve plate according to another embodiment of the invention.
Figure 10:
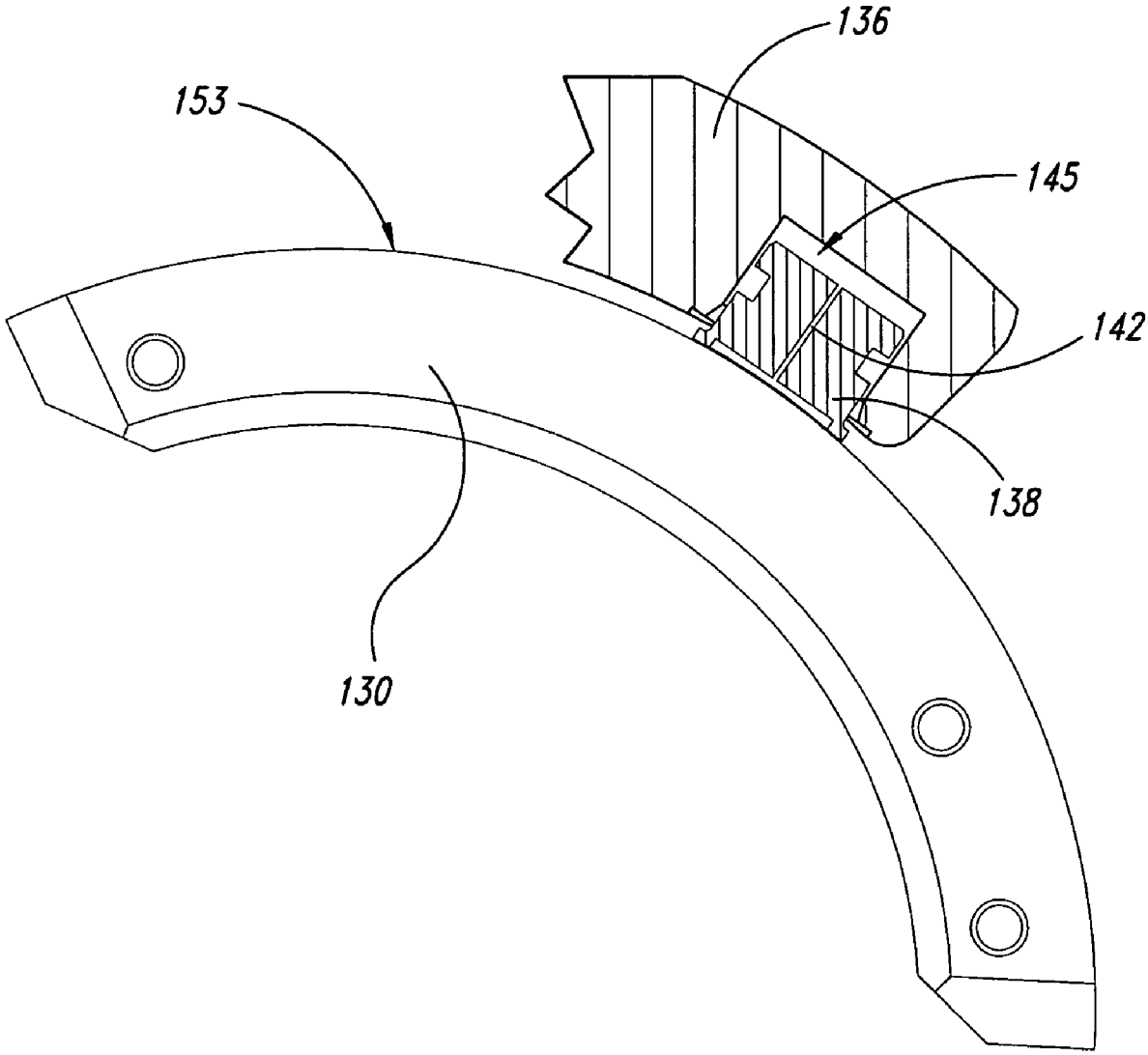
FIG. 10 shows a sectional view of a portion of the valve plate of FIG. 9, a hold-down piston, and a reaction plate.

FIGS. 9 and 10 illustrate an alternative embodiment of the invention. Valve plate 136 includes a plurality of hold-down pistons 138, 149. Each of the hold-down pistons 138 is positioned in a respective hold-down cylinder 145, while each of the hold down pistons 149 is positioned in a respective hold-down cylinder 147. The hold down cylinders 145, 147 are formed in the valve plate 136 in a manner similar to that described with reference to FIG. 6. Each cylinder 145, 147 is in fluid communication with a fluid feed channel of the valve plate 136 in a manner similar to previously described embodiments.

Each of the hold-down pistons 138, 149 includes a fluid passage 142, as shown in the hold-down piston 138 of FIG. 10. The fluid passage 142 is configured to permit fluid to pass from a cylinder end of the hold-down piston to a face 140 thereof. As can be seen in FIGS. 9 and 10, an outer surface of the face 140 of each of the hold-down pistons 138, 149 conforms to the convex surface 153 of the reaction plates 130.

In operation, fluid passing through the fluid passage 142 of the hold-down pistons 138, provides lubrication between the face 140 of the hold-down piston and the reaction plate 130.

Referring to FIG. 9, it may be seen that the surface 151, on which a barrel is configured to rotate, is off-center, with respect to the length of the valve plate. Inasmuch as the barrel contributes to the downward forces holding the valve plate 136 against a back plate, it will be recognized that the downward forces will be uneven across the length of the valve plate 136. To compensate for this imbalance, hold-down cylinders 145 are larger in diameter than hold-down cylinders 147, and hold-down pistons 138 are likewise larger in diameter than hold-down pistons 149. Accordingly, the hold-down pistons 138 each exert more force against the reaction plates 130 than the hold-down pistons 149, thereby balancing the downward forces across the valve plate 136.

A sliding valve plate pump/motor manufactured according to the principals of the present invention is capable of a significantly higher maximum displacement angle than conventional pump/motors, without sacrificing efficiency of the motor due to excessive fluid choking. For example, according to an embodiment of the invention, a maximum stroke angle exceeding 25° is provided. According to another embodiment, a maximum stroke angle exceeding 40° is provided.

Referring to FIG. 6B, the displacement, or stroke angle of the pump/motor 120 is shown to be at zero. Namely, the barrel, relative to the drive plate, is coaxial. In contrast, FIG. 6C shows the pump/motor 120 at a maximum stroke angle. According to the embodiment of FIGS. 6A-6C, a maximum stroke angle is around 45° degrees.

A significant increase in efficiency is realized by increasing the maximum possible stroke angle beyond the nominal 20° available in previously known machines. In a machine with a high stroke angle, the angle of the drive pistons against the thrust plate is increased, which results in more of the force from the piston being directed in the direction of rotation, while less is directed normal to the thrust plate (compare FIGS. 6B and 6C, noting the angles of the pistons 170, relative to the thrust plate 168).

Additionally, because the cylinder barrel is not the only source of clamping force holding the valve plate against the back plate, the shoulders of the cylinders may have a smaller surface area, which in turn means that the cylinder ports may be larger. This results in a machine that can run at high efficiency at higher rpm's than previously known machines, because fluid is less restricted as it passes at high rates into and out of each cylinder.

Tests performed comparing a commercially available pump/motor similar to those described in the background section with a pump/motor having a maximum stroke angle exceeding 40° indicate that the prior art pump/motor achieved a 90% efficiency in a narrow range around 1000 rpm's, and only at stroke angles above about 60% of the maximum stroke angle. In contrast, the large angle pump/motor achieved a 90% efficiency in a range between around 500 and 2500 rpm's, and at stroke angles above about 40%-45% of the maximum stroke angle.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A pump/motor, comprising:

a back plate having first and second fluid ports configured to be differentially pressurized;

a plurality of reaction plates rigidly coupled to the back plate;

a valve plate slideably coupled to the back plate and having first and second fluid feed channels configured to receive fluid from the first and second fluid ports, and a surface configured to receive a rotatable cylinder barrel; and a plurality of hold-down pistons positioned in respective hold-down cylinders formed in the valve plate, each of the hold-down pistons configured to be biased, by pressurized fluid in the respective hold-down cylinder, against a surface of one of the reaction plates, each of the hold-down pistons further configured to non-rotatably slide on the surface of the reaction plate.

2. The pump/motor of claim 1 wherein the valve plate is configured to slide against the back plate in an arc exceeding 20 degrees of rotation.

3. The pump/motor of claim 1, further comprising:

a barrel, rotatably coupled to the valve plate and having a plurality of drive cylinders formed therein;

a plurality of drive pistons, each having a first end positioned in a respective one of the plurality of drive cylinders; and a thrust plate having a surface configured to receive second ends of each of the plurality of drive pistons, the thrust plate coupled to a drive shaft of the pump/motor.

4. The pump/motor of claim 1 wherein the plurality of hold-down pistons comprises at least six hold-down pistons.

5. The pump/motor of claim 1 wherein the valve plate is configured to slide against the back plate in an arc exceeding 40 degrees of rotation.

6. A pump/motor, comprising: a back plate having first and second fluid ports configured to be differentially pressurized; a plurality of reaction plates being separate bodies from, and rigidly coupled to, the back plate; a valve plate slideably coupled to the back plate and having first and second fluid feed channels configured to receive fluid from the first and second fluid ports, and a surface configured to receive a rotatable cylinder barrel; and a plurality of hold-down pistons distributed along first and second edges of a same surface of the valve plate in respective hold-down cylinders formed in the valve plate, each of the hold-down pistons configured to be biased, by pressurized fluid in the respective hold-down cylinder, against a surface of one of the reaction plates.

7. The pump/motor of claim 6 wherein at least one of the hold down pistons distributed along the first edge of the valve plate is in fluid communication with the first fluid feed channel and at least one of the hold-down pistons distributed along the second edge of the valve plate is in fluid communication with the second fluid feed channel.

8. The pump/motor of claim 7 wherein at least one of the hold down pistons distributed along the first edge of the valve plate is in fluid communication with the second fluid feed channel and at least one of the hold down pistons distributed along the second edge of the valve plate is in fluid communication with the first fluid feed channel.

9. The pump/motor of claim 6 wherein each of the plurality of hold-down pistons comprises an aperture passing along a central axis from a first surface to a second surface thereof.

10. The pump/motor of claim 6 wherein a central axis of hold-down cylinders formed in a first side of the valve plate lie in a first plane that is substantially perpendicular to the surface of the valve plate, and a central axis of hold-down cylinders formed in a second side of the valve plate lie in a second plane that is substantially perpendicular to the surface of the valve plate and parallel to the first plane.

11. The pump/motor of claim 6 wherein each of the plurality of hold-down pistons comprises a face that conforms to the surface of the respective reaction plate.

12. The pump/motor of claim 11 wherein each of the plurality of hold-down pistons comprises a fluid passage extending along a central axis thereof from a cylinder end to the face of the respective piston.

13. The pump/motor of claim 6 wherein at least one of the plurality of hold-down pistons has a diameter that is smaller than another of the hold-down pistons.

14. A hydraulic machine, comprising: a back plate having a concave surface whose shape defines a section of a first cylinder on an axis, the concave surface following, as viewed in a first plane perpendicular to the axis, a first arc, and following, as viewed in a second plane transverse to the first plane and intersecting the concave surface, a straight line, the back plate being configured to slideably receive a valve plate thereon; first and second fluid ports formed in the concave surface and configured to transmit differentially pressurized fluid to the valve plate; and first and second reaction plates being separate bodies from, and coupled to, the back plate, each having a convex reaction surface whose shape and position defines a respective section of a second cylinder on the axis, the convex reaction surface of each of the first and second reaction plates following, as viewed in a respective plane lying parallel to the first plane and intersecting the concave surface, a second arc concentric to the first arc, and, as viewed in the second plane, a straight line, the reaction surfaces of the first and second reaction plates substantially facing, and spaced a selected distance from, the concave surface of the back plate.

15. A method of operating a variable displacement hydraulic machine, comprising: coupling a first pressurized fluid source to a rotatable barrel via a first fluid feed channel in a valve plate and a first fluid port in a back plate; coupling a second pressurized fluid source to the rotatable barrel via a second fluid feed channel in the valve plate and a second fluid port in the back plate; changing the displacement of the machine by sliding the valve plate in an arc along a surface of the back plate; and biasing a plurality of hold-down pistons along respective axes lying normal to the surface, against a reaction plate, which is a separate body from, and coupled to, the back plate.

16. The method of claim 15 wherein biasing the plurality of pistons further comprises coupling at least one of the plurality of hold-down pistons to the first pressurized fluid source via the first fluid feed channel and the first fluid port and coupling at least one of the plurality of hold-down pistons to the second pressurized fluid source via the second fluid feed channel and the second fluid port.

17. The method of claim 15 wherein biasing the plurality of pistons comprises coupling at least two of the plurality of hold-down pistons positioned on a first side of the valve plate to the first pressurized fluid source and coupling at least one of the plurality of hold-down pistons positioned on the first side of the valve plate to the second pressurized fluid source.

18. The method of claim 15 wherein biasing the plurality of pistons comprises coupling at least one of the plurality of hold-down pistons positioned on a first side of the valve plate to a fluid feed channel positioned on a second side of the valve plate and at least one of the plurality of hold-down pistons positioned on the second side of the valve plate to a fluid feed channel positioned on the first side of the valve plate.

19. The method of claim 15 wherein changing the displacement of the machine comprises non-rotatably sliding a surface of each of the plurality of hold-down pistons along a face of the reaction plate.

20. A pump/motor, comprising: a back plate having first and second fluid ports configured to be differentially pressurized; a plurality of reaction plates being separate bodies from, and rigidly coupled to, the back plate; a valve plate slideably coupled to the back plate and having first and second fluid feed channels configured to receive fluid from the first and second fluid ports, a surface configured to receive a rotatable cylinder barrel, and a plurality of hold-down cylinders; a cylinder barrel having a plurality of cylinders, rotatably positioned on the surface of the valve plate; and a plurality of hold-down pistons positioned in respective ones of the hold-down cylinders, each of the hold-down pistons configured to be biased, by pressurized fluid in the respective hold-down cylinder, against a surface of one of the reaction plates, the valve plate and cylinder barrel configured such that a net lifting force of the valve plate and cylinder barrel, exclusive of forces generated in the hold-down cylinders, is positive.

21. A valve plate for a hydraulic machine, comprising:

a first side, having an arcuate surface sized to be slideably received on a back plate for changing a displacement of the hydraulic machine;

a second side, having a valve surface configured to receive a rotatable cylinder barrel;

a plurality of hold-down cylinders distributed along first and second edges of the second side of the valve plate;

a first fluid feed channel in the arcuate surface of the valve plate in fluid communication with a first valve plate aperture in the valve surface, at least one of the plurality of hold-down cylinders distributed along the first edge, and at least one of the plurality of hold-down cylinders distributed along the second edge; and a second fluid feed channel in the arcuate surface of the valve plate in fluid communication with a second valve plate aperture in the valve surface, at least one of the plurality of hold-down cylinders distributed along the first edge, and at least one of the plurality of hold-down cylinders distributed along the second edge.

* * * * *